US007490566B2

(12) United States Patent
Hall

(10) Patent No.: US 7,490,566 B2
(45) Date of Patent: Feb. 17, 2009

(54) METHOD AND APPARATUS FOR FORMING VARIABLE LOOP PILE OVER LEVEL CUT LOOP PILE TUFTS

(75) Inventor: Wilton Hall, Ringgold, GA (US)

(73) Assignee: Card-Monroe Corp., Chattanooga, TN (US)

( * ) Notice: Subject to any disclaimer, the term of this patent is extended or adjusted under 35 U.S.C. 154(b) by 0 days.

(21) Appl. No.: 11/755,366

(22) Filed: May 30, 2007

(65) Prior Publication Data

US 2008/0210146 A1 Sep. 4, 2008

Related U.S. Application Data

(60) Provisional application No. 60/892,666, filed on Mar. 2, 2007.

(51) Int. Cl.
*D05C 15/26* (2006.01)
*D05C 15/04* (2006.01)

(52) U.S. Cl. ..... 112/80.4; 112/80.5; 112/80.56

(58) Field of Classification Search ... 112/80.41–80.71, 112/475.17, 475.23
See application file for complete search history.

(56) References Cited

U.S. PATENT DOCUMENTS

| | | | | |
|---|---|---|---|---|
| 2,213,552 | A | 9/1940 | Scharr | |
| 2,562,939 | A | 8/1951 | Noe | |
| 2,750,772 | A | 6/1956 | Bellini | |
| 2,800,096 | A | 7/1957 | Signoret | |
| 2,879,728 | A | 3/1959 | McCutchen | |
| 2,889,791 | A | 6/1959 | Fedevich | |
| 2,982,240 | A | 5/1961 | Kelly | |
| 2,990,792 | A * | 7/1961 | Nowicki et al. | 112/80.52 |
| 3,025,807 | A * | 3/1962 | Gebert | 112/80.52 |
| 3,103,903 | A | 9/1963 | Broadrick et al. | |
| 3,202,379 | A | 8/1965 | Dedmon et al. | |
| 3,375,797 | A | 4/1968 | Gaines | |
| 3,485,195 | A | 12/1969 | Torrence | |
| 3,489,326 | A | 1/1970 | Singleton | |
| 3,618,542 | A | 11/1971 | Zocher | |
| 3,709,173 | A | 1/1973 | Greene | |
| 3,757,709 | A | 9/1973 | Cobble | |
| 3,835,797 | A | 9/1974 | Franks et al. | |
| 3,847,098 | A | 11/1974 | Hammel, Jr. | |

(Continued)

FOREIGN PATENT DOCUMENTS

| | | |
|---|---|---|
| DE | 2503563 | 8/1976 |

(Continued)

OTHER PUBLICATIONS

International Search Report PCT/US2008/002867, mailed Jul. 16, 2008.

(Continued)

*Primary Examiner*—Ismael Izaguirre
(74) *Attorney, Agent, or Firm*—Womble Carlyle Sandridge & Rice, PLLC

(57) ABSTRACT

A tufting machine that includes spaced rows of needles of inserting yarns into a backing material. The needles are engaged by opposed loopers and level cut loop pile hooks that pass between one another so as to engage the opposite row of needles for forming cut pile and loop pile tufts of yarns in the backing material.

10 Claims, 4 Drawing Sheets

U.S. PATENT DOCUMENTS 3,919,953 A 11/1975 Card et al.
3,926,132 A 12/1975 Lear et al.
4,103,629 A 8/1978 Card
4,111,646 A 9/1978 Buckwalter et al.
4,134,348 A 1/1979 Scott
4,138,956 A 2/1979 Parsons
4,155,319 A 5/1979 Short
4,170,949 A 10/1979 Lund
4,175,497 A 11/1979 Lund
4,185,569 A 1/1980 Inman
4,195,580 A 4/1980 Hurst
4,303,024 A 12/1981 Bardsley
4,313,388 A 2/1982 Biggs et al.
4,353,317 A 10/1982 Crumbliss
4,366,761 A 1/1983 Card
4,369,720 A * 1/1983 Beasley ..... 112/80.51
4,379,717 A 4/1983 Levitt et al.
4,397,249 A 8/1983 Slattery
4,419,944 A 12/1983 Passons et al.
4,440,102 A 4/1984 Card et al.
4,448,137 A 5/1984 Curtis et al.
4,466,366 A 8/1984 Hirotsu
4,491,078 A 1/1985 Ingram
4,522,132 A 6/1985 Slattery
4,557,208 A 12/1985 Ingram et al.
4,574,716 A 3/1986 Czelusniak, Jr.
4,602,576 A 7/1986 Cox
4,608,934 A 9/1986 Card et al.
4,619,212 A 10/1986 Card et al.
4,630,558 A 12/1986 Card et al.
4,637,329 A 1/1987 Czelusniak, Jr.
4,667,611 A 5/1987 Yamamoto et al.
4,669,171 A 6/1987 Card et al.
4,691,646 A 9/1987 Card et al.
4,693,191 A 9/1987 Card et al.
4,739,717 A 4/1988 Bardsley
4,815,403 A 3/1989 Card et al.
4,817,541 A 4/1989 Magourik
4,822,241 A 4/1989 Jarvis et al.
4,836,118 A 6/1989 Card et al.
4,841,886 A 6/1989 Watkins
4,856,441 A 8/1989 Kurata
4,860,674 A 8/1989 Slattery
4,864,946 A 9/1989 Watkins
4,903,624 A 2/1990 Card et al.
4,903,625 A 2/1990 Card et al.
5,058,518 A 10/1991 Card et al.
5,094,178 A 3/1992 Watkins
5,158,028 A 10/1992 Beyer
5,182,997 A 2/1993 Bardsley
5,224,434 A 7/1993 Card et al.
5,295,450 A 3/1994 Neely
5,345,885 A 9/1994 Yoshino
5,396,852 A 3/1995 Bardsley
5,400,727 A 3/1995 Neely
5,509,364 A 4/1996 Bardsley
5,513,586 A 5/1996 Neely
5,544,605 A 8/1996 Frost
5,575,228 A 11/1996 Padgett et al.
5,622,126 A 4/1997 Card et al.
5,743,201 A 4/1998 Card et al.
5,896,821 A 4/1999 Neely et al.
5,899,152 A 5/1999 Bardsley et al.
5,954,003 A 9/1999 Beyer et al.
5,983,815 A 11/1999 Card
6,009,818 A 1/2000 Card et al.
6,105,522 A 8/2000 Kato
6,116,173 A 9/2000 Beyer
6,155,187 A 12/2000 Bennett et al.
RE37,108 E 3/2001 Neely
6,213,036 B1 4/2001 Slattery
6,244,203 B1 6/2001 Morgante et al.
6,260,493 B1 7/2001 Dean
6,263,811 B1 7/2001 Crossley
6,283,053 B1 9/2001 Morgante et al.
6,439,141 B2 8/2002 Morgante et al.
6,446,566 B1 9/2002 Bennett et al.
6,502,521 B2 1/2003 Morgante et al.
6,508,185 B1 1/2003 Morgante et al.
6,516,734 B1 2/2003 Morgante et al.
6,550,407 B1 4/2003 Frost et al.
6,672,230 B2 1/2004 Green et al.
6,758,154 B2 7/2004 Johnston
6,807,917 B1 10/2004 Christman et al.
6,834,601 B2 12/2004 Card et al.
6,834,602 B1 12/2004 Hall
7,007,617 B2 3/2006 Johnston
7,107,918 B2 9/2006 Caylor et al.
7,165,500 B1 1/2007 Yoshino
7,216,598 B1 * 5/2007 Christman, Jr. ..... 112/475.23
7,237,497 B2 7/2007 Johnston
7,296,524 B2 11/2007 Beverly
2004/0187268 A1 9/2004 Johnston

FOREIGN PATENT DOCUMENTS

GB 1507166 5/1975
GB 1541074 2/1979
GB 2002040 7/1979
GB 2050447 A 1/1981
GB 2115025 A 9/1983
GB 2165560 A 4/1986
GB 2246371 A 1/1992
GB 2295161 5/1996
GB 2266537 11/1996
WO WO 01/20069 3/2001
WO WO0120069 3/2001
WO WO 03056091 7/2003
WO WO2005054561 6/2005

OTHER PUBLICATIONS

Written Opinion PCT/US2008/002867, mailed Jul. 16, 2008.

* cited by examiner

METHOD AND APPARATUS FOR FORMING VARIABLE LOOP PILE OVER LEVEL CUT LOOP PILE TUFTS

CROSS REFERENCE TO RELATED APPLICATIONS

The present patent application is a formalization of previously filed, co-pending U.S. provisional patent application Ser. No. 60/892,666, filed Mar. 2, 2007, by the inventor named in the present application. This patent application claims the benefit of the filing date of the cited provisional patent application according to the statutes and rules governing provisional patent applications, particularly USC § 119 (e)(1) and 37 CFR § 1.78(a)(4) and (a)(5). The specification and drawings of the provisional patent application are specifically incorporated herein by reference.

FIELD OF THE INVENTION

The present invention generally relates to tufting carpets, and in particular to a method and system for tufting loop pile and cut pile tufts in a backing material to form patterned carpets.

BACKGROUND OF THE INVENTION

In the field of tufting carpets, it has been known to tuft carpets having spaced rows of loop pile and cut pile tufts, including the formation of loop pile and cut pile tufts in the same longitudinal tuft rows of the carpets. For example, U.S. Pat. No. 3,919,953 discloses an apparatus and method for tufting spaced rows of loop pile and cut pile tufts formed in a backing material using a multi-needle tufting machine having two transverse rows of needles with each row cooperating with a series of loop pile loopers or cut pile hooks. Still further, U.S. Pat. Nos. 5,224,434 and 5,499,588 disclose methods and apparatus for producing cut pile and loop pile tufts in the same longitudinal rows of tufting and which further provide for the shifting of the needle bars carrying spaced rows of needles to provide enhanced pattern effects such as the formation of cut and loop pile tufts in the same tuft rows.

For higher or finer gauge tufting machines, i.e., 5/32-1/16 gauge machines, however, as the spacing between the needles is narrowed for forming finer gauge carpets, problems exist whereby the cut pile hooks can engage the previously formed loop pile tufts, potentially resulting in the cutting or pulling of such tufts, creating defects in the carpet. Additionally, there are increasing demands for the capability of tufting machines to produce carpets with wider varieties of pattern designs and effects, including at finer gauges.

Accordingly, it can be seen that a need exists for a method and system of forming cut pile and loop pile tufts in a backing material to form patterned carpets that addresses the foregoing related and unrelated problems in the art.

SUMMARY

Briefly, described, the present invention generally relates to a method and apparatus for forming or introducing loop pile and level cut loop pile tufts of yarns into a backing fabric passing through a tufting zone of a tufting machine to form tufted carpets at varying pile heights. The tufting machine generally will include first and second rows of transversely spaced needles that receive a series of yarns from a yarn source or yarn feed drive mechanism. The needles generally are spaced along needle bars at a prescribed gauge spacing, i.e., ½ inch-1/16 inch, etc., and are reciprocated into and out of engagement with a backing material passing through a tufting zone of the tufting machine for introduction of tufts of yarn into the backing material to form tufted carpets. The yarns can be fed to the needles using a variety of yearn fed rolls or systems, including scroll, roll and single end yarn feed systems to provide varying pattern effects including pile height differentials. For example, the yarns can be fed to the needles from an Infinity Yarn Feed System as manufactured by Card-Monroe Corp. The needle bars also can be shifted laterally to provide further pattern effects.

A looper mechanism is mounted below the backing material and generally includes spaced, transversely extending rows of loop pile loopers and level cut loop pile hooks or loopers mounted along the upstream and downstream or loop pile and cut pile sides, respectively, of the tufting zone. Each of the loop pile loopers generally includes a shank portion attached to a looper support and a bill or forward portion extending forwardly from the shank portion toward an associated needle. The bill of each looper will engage or strike a take-off portion of its associated needle to engage and pickup a loop of yarn from the needle for forming loop pile tufts in the backing material. Similarly, the level cut loop pile hooks each include a shank or body portion and a throat portion that extends forwardly from the shank portion and terminates in a hooked or curved forward end, and a clip that is moved into engaging position by an actuator for forming loop pile tufts according to the pattern design being tufted. Each level cut loop pile hook will engage an associated needle at a pickup or takeoff portion thereof so as to pickup and form loops of yarns along the throat portion of the hook. Each level cut loop pile hook further generally will include a knife assembly associated therewith, which includes a knife or cutting blade that is moved in a reciprocal cutting motion so as to sever or cut selected ones of the loops of yarn collected along the throat of its associated level cut loop pile hook to form cut pile tufts in the backing material.

With the system of the present invention, the level cut loop pile hooks and loop pile loopers generally are staggered transversely from each other. As a result, the loop pile loopers can be aligned with a gap between each of the level cut loop pile hooks and each of the level cut loop pile hooks accordingly are aligned with the gaps defined between each of the loop pile loopers. As the needles penetrate the backing, the loop pile loopers and level cut loop pile hooks will be reciprocated into engagement with their associated needles, and in some applications, can be positioned so as to pass between each other such that the loop pile loopers will pass through the gaps between the level cut loop pile hooks to engage the second or rear, downstream row of needles, while the level cut loop pile hooks will reach through the gaps between the loop pile loopers and engage the first or upstream row of needles of the tufting machine to enable level cut loop pattern formation and functionality with or without a pile differential on the cut-loop side of the tufting machine.

Further, the knives can be of the same or of an opposite hand cutting to the takeoff or pickup needles of the first row of needles and can be positioned on the pickup side their associated level cut loop pile hooks, so as to be positioned along the same side of their level cut loop pile hooks as the needle being engaged by the level cut loop pile hooks. In such an arrangement, during operation of the tufting machine, the loop pile loopers and level cut loop pile hooks will tend to pass between each other and engage the opposite row of needles as the needles penetrate the backing material to form both loop pile and level cut loop pile tufts of yarns in the backing material, as the knives of each of the cut pile hooks are moved in a reciprocating cutting motion to engage and cut the loops collected along the throat portions of their associated level cut loop pile hooks to form the cut pile tufts as needed. Additionally, as the clips of the level cut loop pile hooks are actuated and moved to their engaged position, they will prevent the capture and retention of loops of yarn on the level cut loop pile hooks to enable formation of additional loop pile tufts in the backing material.

Various objects, features and advantages of the present invention will become apparent to those skilled in the art upon a review of the following detailed description when taken in conjunction with the accompanying drawings.

DETAILED DESCRIPTION OF THE INVENTION

Figure 1:
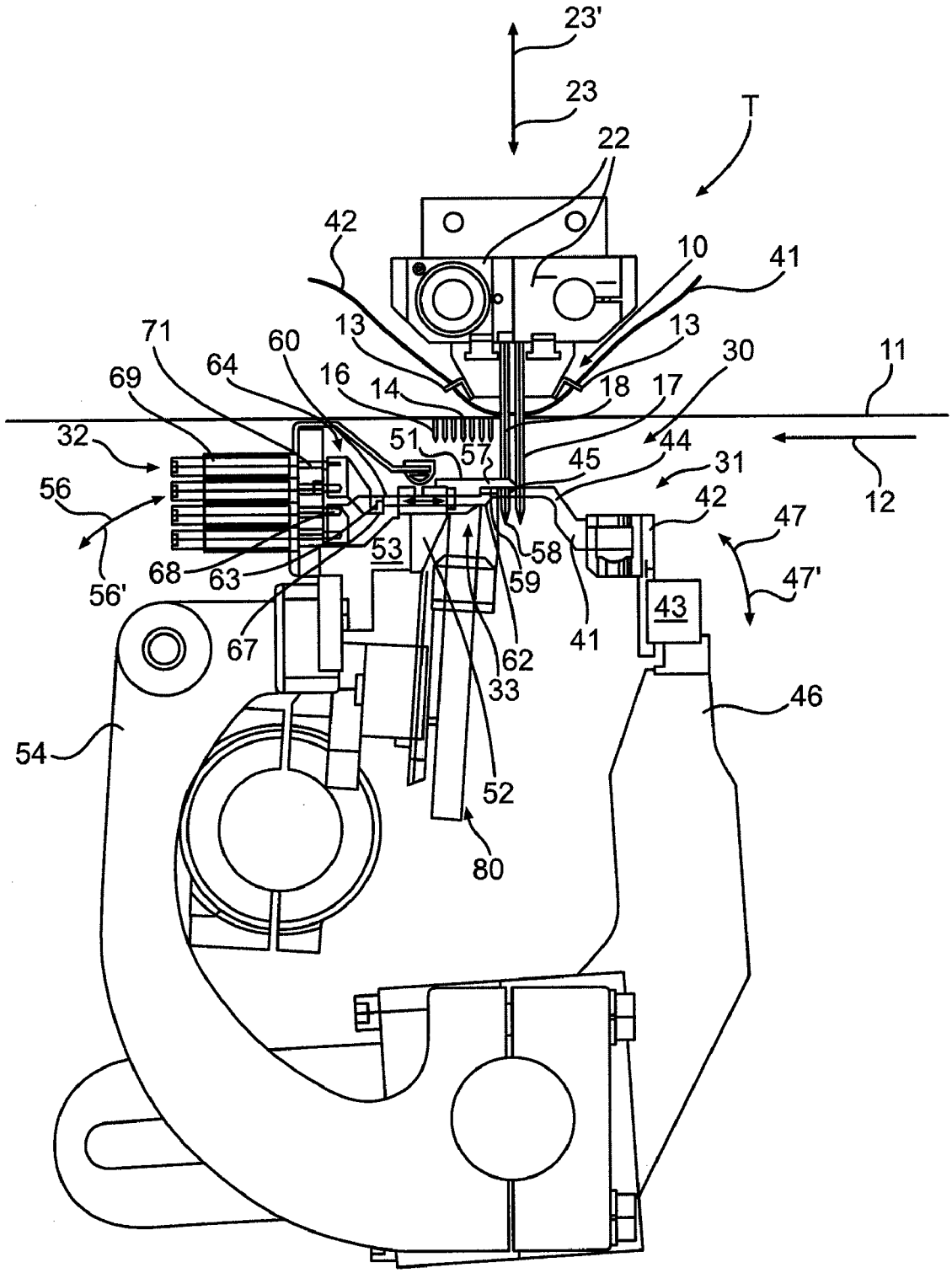
FIG. 1 is a side elevational view illustrating the engagement of the level cut loops pile hook assemblies and loop pile loopers with the opposed rows of needles according to the present invention.
Figure 2:
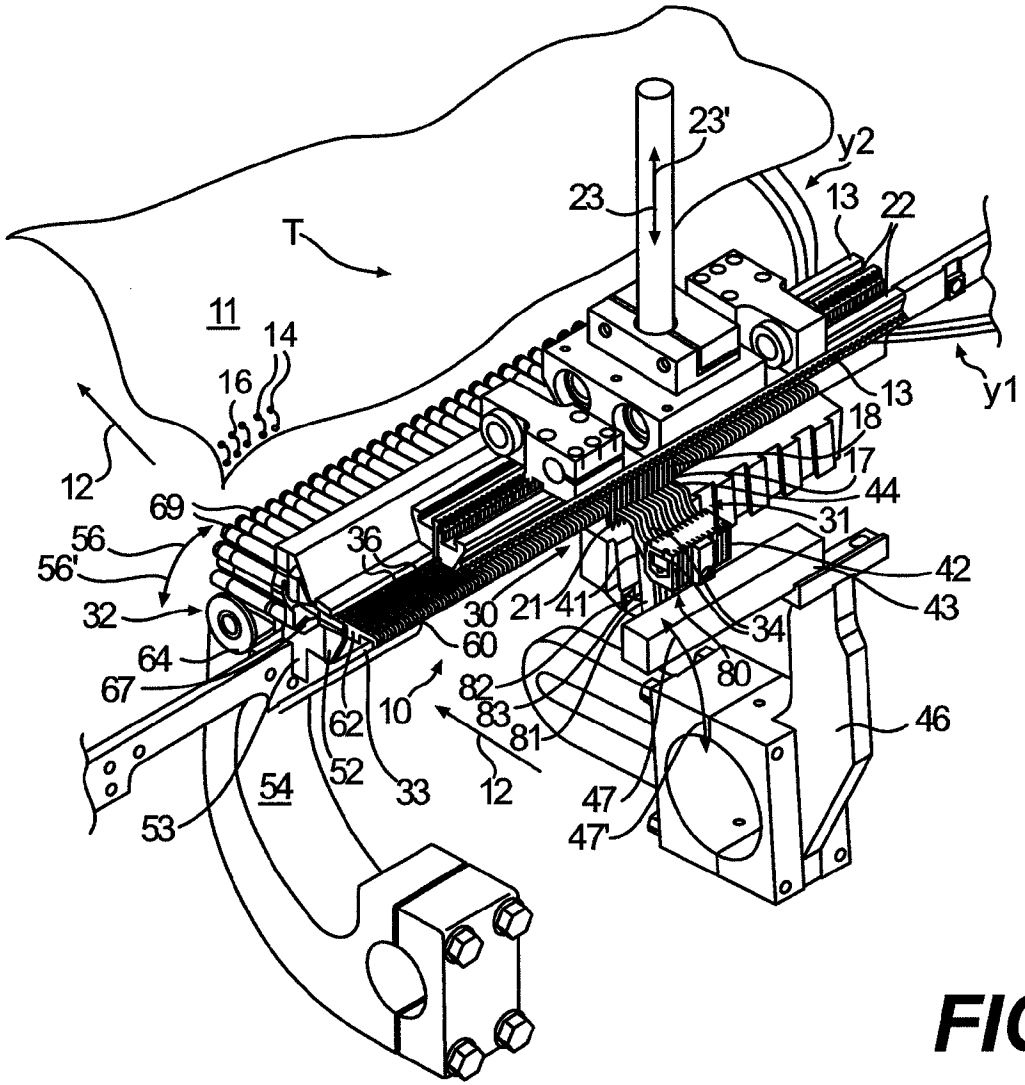
FIG. 2 is a perspective illustration showing the movement of the loop pile loopers and level cut loop pile hooks between one another into engagement with the opposed rows of needles according to the present invention.

Referring now in greater detail to the drawings in which like numerals indicate like parts throughout the several views, the present invention generally relates to a method and system for forming tufting carpets having loop pile and cut pile tufts of yarns Y1 and Y2 formed therein for forming various sculpted or other patterned effects in the carpet. As illustrated in FIGS. 1-2, a tufting machine T utilizing the present invention, generally will include a tufting zone 10 through which a backing material 11 is fed in a feed direction, generally indicated by arrows 12 for the introduction of yarns Y1 and Y2 fed from a yarn feed device or source (not shown) through guides 13 for insertion into the backing material 11 to form loop pile tufts 14 (FIG. 1) and cut pile tufts 16, respectively, in the backing material. Such yarn feed devices could include various yarn feed pattern attachments such as scroll, roll, single, or double end yarn feed attachments such as the Infinity™ and Yarntronics™ Pattern attachment/yarn feed systems manufactured by Card-Monroe Corp. to control the yarn feed for producing various pattern effects.

The tufting machine generally will include two spaced rows of needles 17 and 18, although only one needle 17, 18 of each row is shown for clarity. The first or forwardmost row of needles 17 generally comprise cut pile needles for inserting level cut loop pile yarns Y1 in the backing 11, while the second or rear row of needles 18 comprise loop pile needles for inserting loop pile yarns Y2 into the backing material 11 as shown in FIG. 1, and with the rows of needles 17/18 being staggered by about 1/16 inch-5/32 inch up to about ½ inch or more. Each needle 17 or 18 includes a pickup or takeoff area or portion 19 (FIG. 3) along their lower end or point 21 and a channel along which a yarn Y1 or Y2 is received. The needles generally are mounted to a pair of reciprocating needle bars 22 (FIGS. 1-2) that are driven by the operation of the main shaft of the tufting machine so as to move the needles about a vertically reciprocating path indicated by arrows 23/23' into the backing material 11 for delivering the yarns Y1-Y2, thereto. The needle bars 22 further can be shiftable needle bars that are shifted transversely across the tufting zone by a shift mechanism (not shown) according to pattern instructions. Additionally, while two needle bars are shown, it is envisioned that a single needle bar, which further could be shifted transversely, with two rows of transversely spaced needles theralong also could be utilized in the tufting machine of the present invention.

Mounted beneath the tufting zone 10 is a looper mechanism 30, as indicated in FIG. 1. The looper mechanism 30 generally includes a series of loop pile loopers 31 mounted in spaced series along an upstream or first side of a tufting zone, beneath the cut pile needles 17 and facing in the feed direction 12 of the backing material 11. The looper mechanism 30 also includes a series of transversely spaced level cut loop pile looper/hook assemblies 32, each including a level cut loop hook or looper 33 and being positioned along the downstream side of the tufting zone below the loop pile needles 18, facing in a direction opposite the feed direction 12. It will be understood by those skilled in the art that while only a few loop pile loopers and level cut loop pile hook assemblies have been illustrated in the drawings for clarity, in practice, the number of loop pile loopers and level cut loop pile hook assemblies will be provided in spaced series extending across the width of the tufting machine, with the number of loop pile loopers and level cut loop pile hook assemblies being dependant upon the size of the tufting machine and number of needles thereof.

Figure 4:
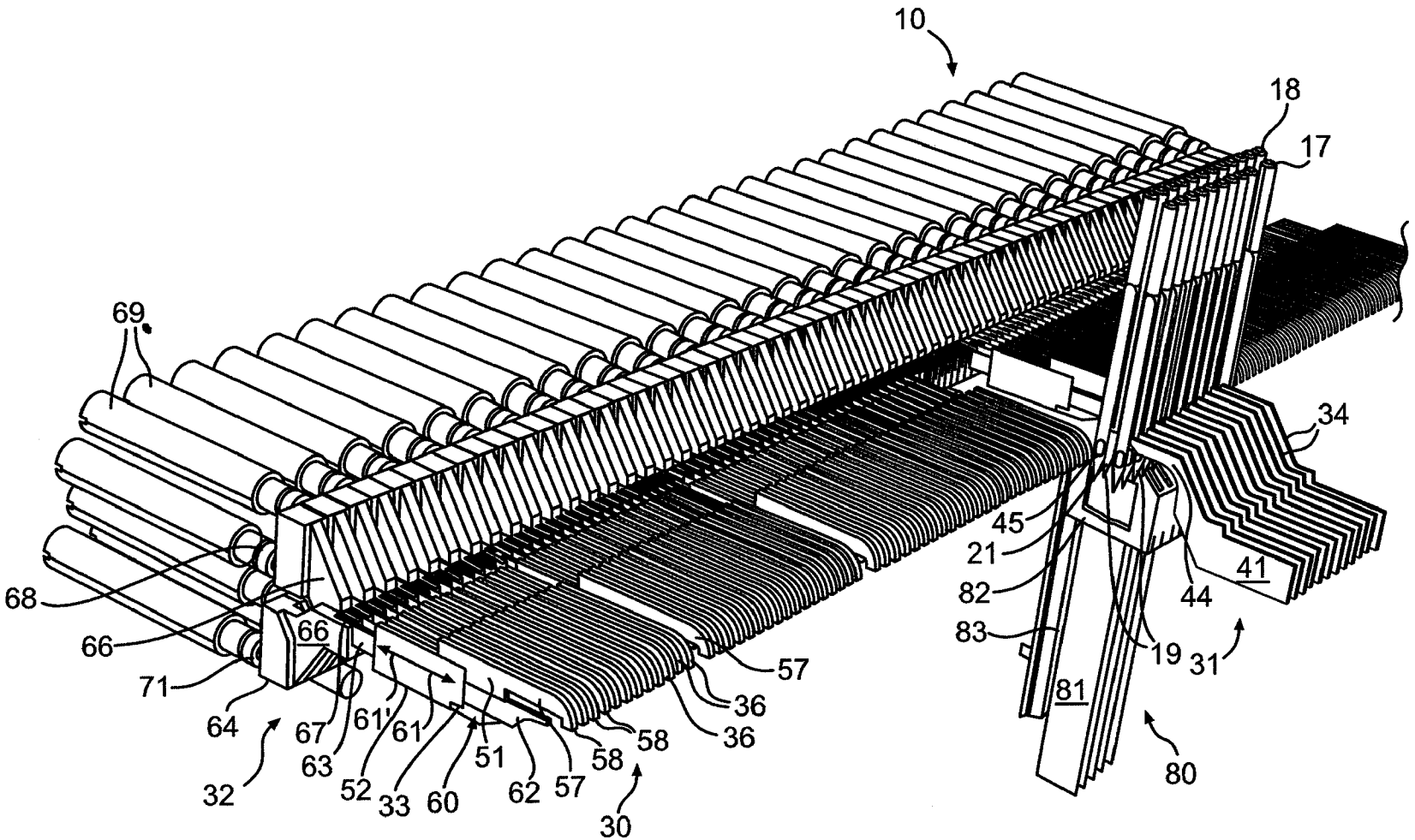
FIG. 4 is a perspective illustration of the interaction between the level cut loop pile hooks, loop pile loopers, and knife asemblies.

As shown in FIGS. 2 and 4, the loop pile loopers 31 are spaced transversely apart so as to define gaps 34 therebetween, while the level cut loop pile hooks 33 are similarly transversely spaced and correspondingly define gaps 36 therebetween. In one example embodiment of the present invention, the loop pile loopers 31 can be aligned with the gaps 36 between each of the level cut loop pile hooks 33, which in turn each can be aligned with the gaps 34 defined between the loop pile loopers. Similarly, in such an embodiment, the cut pile needles 17 will be positioned so as to travel through the gaps 34 between the loop pile loopers, while the loop pile needles 18 are positioned to reciprocate through the gaps 36 between the level cut loop pile hooks 33. In operation, the loop pile loopers and level cut loop pile hooks accordingly will pass through the respective gaps 34 and 36 therebetween so as to engage the cut pile and loop pile needles 17/18, respectively, as indicated in FIGS. 2 and 4, in an intermeshing or interleaving movement in order to engage their respective needles 17/18 on the opposite sides of the tufting zone.

Figure 3:
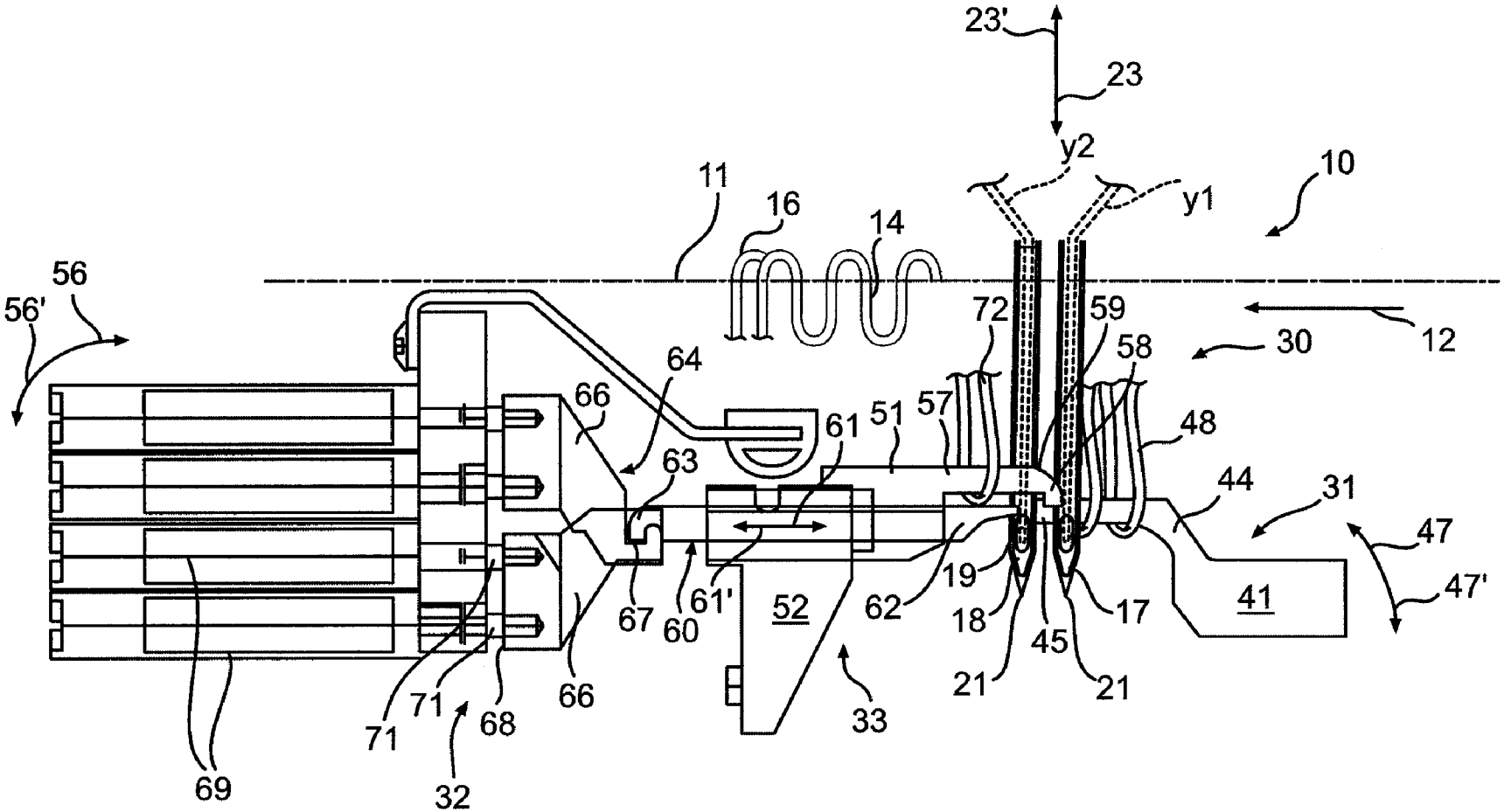
FIG. 3 is a side elevational view of the level cut loop pile hook assembly of FIG. 1.

As illustrated in FIGS. 1 and 3, each loop pile looper 31 of the looper mechanism 30 generally includes a shank portion 41 that is mounted in a holder, block, or module 42 mounted along a gauge bar 43 (FIG. 2), and a forward body portion 44 that terminates in a tapered bill or forward end 45. During operation of the tufting machine, the loop pile loopers are rocked forwardly by a looper drive 46 that reciprocates the gauge bar 43, and with it the loop pile loopers 31, in the direction of the needles 18, as indicated by arrows 47 and 47' in FIG. 1. As a result, the bill portion 44 of each loop pile looper 31 is reciprocated toward its associated loop pile needle and can pass into the gap 34 (FIGS. 2 and 4) between each of the level cut loop pile hooks 32 as needed to engage the needle. The bill portion 44 of each loop pile looper engages the takeoff portion 19 of its associated loop pile needle 18, so as to pick up and pull a loop of yarn away from its associated loop pile needle 18. As each loop pile looper 31 is reciprocated rearwardly in the direction of arrow 47' (FIG. 1) and the loop pile needles 18 are reciprocated vertically back to their raised position out of engagement with the backing material, the loop pile loopers pull the yarns 13 away from the needles 18. As a result, as indicated in FIG. 3, a series of loops of yarn 48 will be formed along the bill portion 44 of each loop pile looper 31 for forming the loop pile tufts 14 in the backing material 11.

As illustrated in FIGS. 1 and 3, each of the level cut loop pile hook assemblies 32 comprises a level cut loop hook 33 that includes a shank 51 portion mounted within a holder, support or module 52 (FIGS. 1-2) that is mounted along a gauge bar 53. The gauge bar 53 and holder or supports 52 are driven by a drive mechanism 54 so as to carry the level cut loop hooks 33 about a reciprocal motion indicated by arrows 56 and 56', into and out of engagement with a cut pile needle 17 as illustrated in FIGS. 1 and 3. The level cut loop hooks 33 each further include a tapered throat portion 57 projecting forwardly from the shank 51 and terminating in a hooked forward or distal end 58. The level cut loop hooks each further include a pickup side 59 for engaging the take off or pickup area 19 of the cut pile needles 17.

As additionally shown in FIGS. 1 and 3, the level cut loop pile hook assemblies 32 further include a series of extensible clips 60 that are moveable through the holders 52 in the direction of arrows 61 and 61' between a retracted position to an extended position. Each clip includes an elongated body, generally formed from metal, plastic, or other rigid, durable material, with a tapered first or forward end 62 and a second or rear end 63 that is received within a gate 64. As indicated in FIGS. 1, 3 and 4, each gate 64 has an upwardly or downwardly slanting front position 66, with a slot 67 formed therein for receiving the rear end 63 of a clip 60, and a rear portion 68. Actuators, such as hydraulic or pneumatically operable cylinders 69, are mounted in an array behind the rear portions 68 (FIG. 3) of the gates 64, with the cylinder rod 71 of each cylinder 69 attached to a corresponding gate 64 for one of the level cut loop pile hook assemblies 32. As the actuators 69 are engaged and extend their cylinder rods, their associated gates 64 accordingly are extended so as to move the selected clips 60 to their extended positions with their front ends or tips 62 positioned adjacent the hooked forward ends 58 of their level cut loop pile loopers 33. In this position, the area behind the hooked forward end 58 is closed off to prevent loops of yarns from being captured and retained therealong.

In similar fashion to the loop pile loopers 31, as the level cut loop hooks 33 are reciprocated in the direction of arrow 56, their hooked, forward ends 58 can pass through an associated gap 34 between adjacent loop pile loopers 31 as needed, and will engage the takeoff portions 19 of their associated cut pile needles 17 along the upstream or front side of the tufting zone 10, as the needles 17 are reciprocated to their lowered, engaging position, penetrating in the backing material. As the hooked front ends 58 of the level cut loop hooks 33 engage takeoff portions 19 of their associated needles 17 and pick up and pull the yarns away from the needles 17, the needles generally begin to move along their return stroke, as they are reciprocated upwardly, after which the level cut loop hooks 33 begin to be moved rearwardly in the direction of arrow 56'. As a result, a series of loops of yarn 72 will be formed along the throat portions 57 of the level cut loop pile hooks. These loops of yarn will extend about the clips 60 when the clips are in their extended positions and thus generally will be pulled free from the level cut loop pile hooks as they are reciprocated rearwardly in the direction of arrow 56'. When the clips are in their retracted positions, however, the loops of yarn 72 will be captured on the throats of the level cut loop hooks, as indicted in FIG. 3, and retained for cutting by knife assemblies 70.

As further illustrated in FIGS. 1-4, each level cut loop pile hook assembly 32 has a knife assembly 80 that is mounted adjacent the throat portion 57 of its associated level cut loop pile hook 33. Each knife assembly 80 includes a cutting blade or knife 81 mounted in a holder 82 (FIGS. 1 and 4) and having a cutting edge 83. Each of the cutting blades 81 are reciprocated about a cutting path along the throat portion 57 of its associated level cut loop pile hook 33, so as to engage and sever the loops of yarn 72 (FIG. 3) formed along the throat portion 57 of each level cut loop pile hook in order to form the cut pile tufts 16 (FIG. 1) in the backing material 11.

Typically, in conventional tufting machines, the knife will be of the same "hand" cutting as the level cut loop pile hook, i.e., a right hand cutting blade for a right hand takeoff level cut loop pile hook, or a left hand cutting blade for a left hand takeoff level cut loop pile hook, and generally will be positioned on the opposite side of the takeoff or pickup region of the loop pile loopers. With the level cut loop pile hook assemblies 32 of the present invention, however, the knives 81 (FIG. 4) can be of the same "hand" as the level cut loop pile hooks, or alternatively, can be of an opposite hand cutting to the pickup of their associated level cut loop pile hooks 33. For example, if the level cut loop pile hook is a left hand pickup hook, a right hand cutting blade or knife can be used, and conversely, for a level cut loop pile hook having a right hand pickup hook, a left hand cutting knife can be used. The knives 81 further can be mounted along the pickup side of their level cut loop pile hooks as indicated in FIG. 4. As a result, the knives will be aligned with, and thus are on the same side of their level cut loop pile hooks as their respective cut pile needles as the needles are engaged by their associated level cut loop pile hooks, although it is also possible to have the needles positioned on the opposite sides of the level cut loop pile hooks from the knives.

As the loop pile loopers and level cut loop pile hook assemblies 31 and 32 (FIG. 1) are reciprocated in the direction of arrows 47/47' and 56/56', respectively, and the loop pile and cut pile needles penetrate the backing material, the bills and throats of the loop pile loopers and level cut loop pile hooks will pass adjacent each other without obstruction and will engage their associated loop pile and level cut loop pile needles 18 and 17 to pickup and to form loops of yarn on the throat portion of each of the looper and level cut loop pile hooks. Thereafter, as the knives of each of the level cut loop pile hook assemblies are reciprocated about their cutting path, they will engage and sever the loops of yarns contained on the throats of each of the cut pile hooks to form the cut pile tufts 16. At the same time, the loops of yarn held on the bills of the loop pile loopers are simply pulled off the loop pile loopers as the backing material is moved along its path of travel 12, leaving the loop pile tufts 14 of yarn in the backing material 11. Thus, the backing fabric will have cut pile and loop pile tufts of yarn formed therein.

Additionally, the actuators 69 of the level cut loop pile assemblies 32 also can be engaged selectively as required by the pattern being formed to form additional loop pile tufts. As the selected actuators are engaged, they extend their cylinder rods so as to cause the clips 61 of selected ones of the level cut loop pile hook assemblies 32 to be moved to their extended positions. The loops of yarn are thus extended about the forward ends of the clips and are kept from being captured and retained by the hooked ends 58 of their associated level cut loop pile hooks 33. As the level cut loop pile hooks thereafter are reciprocated rearwardly in the direction of arrow 56', the loops of yarns formed about the clips/level cut loop pile hooks of yarns are pulled off the level cut loop pile hooks to form additional loop pile tufts and thus are not engaged and cut by the knives 81.

The present invention thus enables the passing of the loop pile loopers and level cut loop pile hooks through the gaps defined therebetween with the incidents of previously sewn loops of yarn being engaged by the level cut loop pile hooks during the production of finer or smaller gauge (i.e., 5/32-1/16 gauge) carpets being minimized, while allowing the formation of varying loop and level cut lop pile effects in the same backing fabric or carpet. The present invention further enables the stagger between the rows of needles to be reduced to as short as approximately ½ inch-approximately ¼ inch or less without the knives engaging the previously sewn loops or otherwise engaging and interfering with the operation of the loopers. As a result, given the reduction in the stagger, the problems of side matching, i.e., matching of the left and right seam of a carpet, are minimized since the stagger can be reduced, which correspondingly reduces the stretching and/or necking of the backing material as the backing material passes passing through the tufting zone. The use of varying yarn feeds also enables formation of variable pile height loop pile tufts together with level cut loop pile tufts in the same carpet or tufted article.

It will be further understood by those skilled in the art that while the present invention has been described above with reference to preferred embodiments, numerous variations, modifications, and additions can be made thereto without departing from the spirit and scope of the present invention as set forth in the following claims.

What is claimed is:

1. A method of forming spaced rows of cut pile and loop pile tufts in a base fabric, comprising:

moving a base fabric along a path of travel through a tufting zone;

engaging the base fabric with a first row of spaced needles carrying a plurality of yarns through the base fabric;

engaging the base fabric with a second row of spaced needles, transversely spaced from the first row of needles across the tufting zone and carrying a second plurality of yarns through the base fabric;

moving a plurality of level cut loop pile hooks having a pickup across the tufting zone between the needles of the second row of needles and into engagement with the yarns carried by the needles of the first row of needles;

selectively engaging a series of clips associated with each of the level cut loop pile hooks so as to move the clips between retracted and extended positions for forming cut or loop pile tufts of the yarns carried by the first row of needles;

providing a series of knives of an opposite hand cutting to the pickup of each of the level cut loop pile hooks, each positioned adjacent one of the level cut loop pile hooks and reciprocating the knives into selective engagement with loops of yarns captured along the level cut loop pile hooks to form the cut pile tufts in the base fabric; and moving a series of loopers across the tufting zone between the needles of the first row of needles and into engagement with the yarns carried by the needles of the second row of needles to form the loop pile tufts in the base fabric.

2. The method of claim 1 and wherein providing the knives adjacent each level cut loop pile hook comprises positioning each knife on an opposite side of each level cut loop hook from an associated one of the needles of the first row of needles.

3. The method of claim 1 and further comprising staggering the first and second rows of needles up to approximately ½ inch apart.

4. The method of claim 1 and wherein providing the knives adjacent each level cut loop pile hook comprises positioning each knife along a pickup side of an associated level cut loop pile hook.

5. The method of claim 1 and wherein moving the plurality of level cut loop pile hooks and moving the plurality of loopers comprises passing the level cut loop pile hooks through gaps between the loopers and passing the loopers through gaps between the level cut loop pile hooks, interleaving the loopers and level cut loop pile hooks as the level cut loop pile hooks and loopers engage the needles of the first and second rows of needles, respectively.

6. A method of forming tufted articles having cut pile tufts and loop pile tufts, comprising:

moving a backing through a tufting zone;

reciprocating a first and a second row of needles, each carrying a plurality of yarns into and out of the backing moving through the tufting zone;

moving a series of spaced level cut loop hooks positioned along a cut pile side of the tufting zone between a series of loopers positioned along a loop pile side of the tufting zone and into engagement with the needles of the first row of needles to pull loops of yarn therefrom to form cut pile and loop pile tufts;

moving and intermeshing the loopers between the level cut loop hooks and engaging the needles of the second row of needles to pull loops of yarns therefrom for forming loop pile tufts;

selectively moving a series of clips, each associated with one of the level cut loop hooks, between an engaging position wherein the loops of yam engaged and pulled from the needles by the level cut loop pile hooks are prevented from being captured along selected ones of the level cut loop hooks to thus selectively form loop pile tufts, and a non-engaging position enabling the loops of yarns to be captured on the level cut loop pile hooks to selectively form cut pile tufts; and engaging and severing the loops of yarns captured along the level cut loop pile hooks with a series of knives to form the cut pile tufts.

7. The method of claim 6 and further comprising positioning each of the knives along a pickup side of a level cut loop pile hook associated therewith.

8. The method of claim 7 and further comprising providing knives of an opposite hand cutting to the pickup of the level cut loop pile hooks.

9. The method of claim 6 and further comprising providing knives of an opposite hand cutting to a pickup of the level cut loop pile hooks.

10. The method of claim 6 and further comprising staggering the first and second rows of needles up to approximately ½ inch apart.

* * * * *